United States Patent [19]

Rätz et al.

[11] 3,987,543

[45] Oct. 26, 1976

[54] PORTABLE MOTOR CHAIN SAW

[75] Inventors: Adolf Rätz, Korb; Robert Schäfer, Oppenweiler-Aichelbach, both of Germany

[73] Assignee: Andreas Stihl Maschinenfabrik, Neustadt, Germany

[22] Filed: Apr. 8, 1975

[21] Appl. No.: 566,533

Related U.S. Application Data

[63] Continuation-in-part of Ser. No. 500,513, Aug. 26, 1974, abandoned, which is a continuation of Ser. No. 330,725, Feb. 8, 1973, abandoned.

[30] Foreign Application Priority Data

Feb. 9, 1972 Germany ..... 2206169

[52] U.S. Cl. ..... 30/383

[51] Int. Cl.[2] ..... B27B 17/02

[58] Field of Search ..... 30/371, 381, 382, 383, 30/384, 385, 386, 387; 228/249; 83/743

[56] References Cited

UNITED STATES PATENTS

| | | | |
|---|---|---|---|
| 2,962,812 | 12/1960 | Gommel | 30/383 |
| 3,241,228 | 3/1966 | Rayniak | 30/387 X |
| 3,744,363 | 7/1973 | Espana | 30/383 |
| 3,858,321 | 1/1975 | Conaty | 228/249 X |

OTHER PUBLICATIONS

A Dictionary of Metallurgy by A. D. Merriman, p. 340.

Metals Handbook–8th Ed., vol. 2, p. 116, by American Society for Metals.

*Primary Examiner*—Al Lawrence Smith
*Assistant Examiner*—J. C. Peters
*Attorney, Agent, or Firm*—Walter Becker

[57] ABSTRACT

A portable motor chain saw with a guiding rail structure which on at least a portion of its circumferential surface on which the saw chain is slidably guided has a semicircular head by which the chain is deviated while a reinforcing layer of Stellite is applied on the region of the deviating portion of the guiding rail structure, the Stellite together with the adjacent guiding rail portion being tempered.

4 Claims, 2 Drawing Figures

PORTABLE MOTOR CHAIN SAW

Figure 1A:
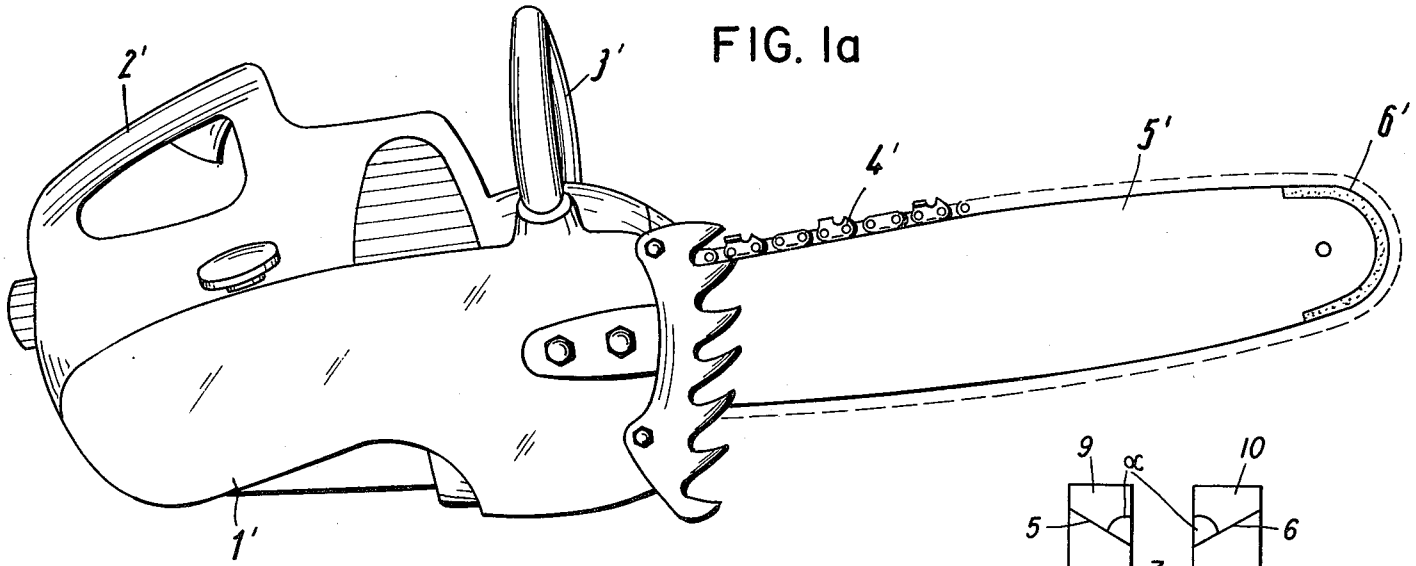

This is a continuation-in-part application based on co-pending continuation application Ser. No. 500,513-Ratz et al. filed Aug. 26, 1974 now abandoned which in turn was filed as a continuation of parent application Ser. No. 330,725-Ratz et al. filed Feb. 8, 1973 now abandoned.

The invention concerns a guiding track for a portable motor chain saw; the chain saw has a guiding segment that is U-formed in crossection at right angles to the guiding plane; guide webs of the chain saw members engage between the shanks of the U-formed guiding segment; the sides of the shanks directed toward each other form guiding surfaces provided with a reinforcing layer consisting of highly rigid alloy. The reinforcing layer of alloy is applied upon an engagement surface of the particular shank or leg of the guiding track.

In operation the saw chain runs or extends between the shanks of the guiding track which makes possible a certain guiding of the saw chain. The shanks of the guiding track are subjected to a very high wear load by way of the transverse forces exerted by the saw chain. This load can become so great that the reinforcing layer becomes separated from the shanks of the guiding track and thereby the same would lead to a premature wear of the guiding track. In order to reduce the high wear, provision is to produce the free end of the shanks or legs out of a highly wear-resistant non-ferrous metal alloy, especially Stellite. This reinforcing layer becomes welded upon the free ends of the shanks or legs whereby the engagement surface of the shanks or legs for the reinforcing layer extends at right angles or vertically to the guiding surfaces of the shanks. However, also the utilization of Stellite as wear-resistant alloy for the reinforcing or armoring layer so far has not led to any satisfactory result.

An object of the present invention is to create a guide rail for a portable motor chain saw which also withstands high loads without requiring as a necessity for this purpose a great technical complexity.

According to the present invention this object becomes resolved thereby that at least one part of the engagement surface encompasses an angle $\alpha$ of less than 90° with the guiding surface of every shank or leg.

By way of this embodiment of the guiding track there becomes available in a simple manner a higher loading capability of the shanks or legs than with the previously known embodiments. Since the engagement surface lies at an incline to the guiding surface of the particular shank or leg, the transverse forces exerted by the saw chain cannot be effective completely upon the reinforcing or amoring layer. The shanks or legs of the guiding track are supported much more as a consequence of the inclined engagement surface of the reinforcing or armoring layer so that this can withstand such high loading. Furthermore there is noted that by way of this inclined position the engagement surface thereof relative to the crossectional surface of the shank or leg being provided at right angles or vertically with respect to the guiding surface of the shank or leg is greater than with an engagement surface extending at right angles or vertically to the guiding surface. Thereby there becomes attained a considerably greater supporting effect in comparison to the known embodiments with the same shank or leg thickenss so that the danger of separation of the reinforcing or armor layer from the shanks or legs of the guiding rail becomes reduced still further.

The present invention becomes described in detail subsequently in a sample embodiment illustrated in the drawing in which the guiding track is illustrated according to the invention.

Figure 1:
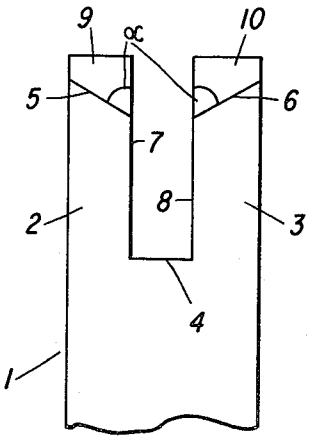

FIG. 1 shows a guiding rail and

FIG. 1*a* shows a motor chain saw having features in accordance with the invention.

The guiding rail 1 has a U-profile in crossection (FIG. 1) at right angles or vertically with respect to the guiding plane and provides two shanks or legs 2 and 3 which are spaced from each other and parallel to each other. The non-illustrated saw chain becomes slidably guided between both shanks or legs 2 and 3 upon a web 4 of the guiding track 1. The free end of every shank or leg 2 and 3 is inclined whereby the upper side 5 and 6, respectively is inclined downwardly in a direction upon the pertaining other shank or leg so that the spacing of the web 4 of the guiding track 1 measured at the sides 7 and 8 formed along locations toward each other and forming the guiding surface for the saw chain is smaller toward the shank end than the measurement of spacing at the sides away from each other as to spacing toward the free end. The upper sides 5 and 6 of the shanks 2 and 3 encompass or define at a time an equal angle $\alpha$ with the guide surfaces 7 and 8 which is smaller than 90°. A reinforcing or armor layer 9 respectively 10 becomes applied upon the upper side 5 respectively 6 serving as the engagement surface and such application occrurs, for instance, by way of welding with an autogenous or oxyacetylene flame or with an electrical arc lamp welding. The reinforcing layer 9 respectively 10 consists of a highly rigid non-ferrous metal alloy, preferably Stellite, with a composition of, for instance 4 to 9% wolfram (tungsten), approximately 25 – 32% chromium and at least 56 to 66% cobalt. This reinforcing layer 9, 10 has the same width as the particular shank means 2, 3 of the guiding track 1 so that this layer forms a continuation of the shank means 2 respectively 3. The reinforcing layer 9 respectively 10 lies in its entire surface relationship upon the engagement surface 5 respectively 6 of the shank means 2 respectively 3.

By way of inclined engagement surface means 5 respectively 6 direct downwardly in a direction upon the oppositely located shank means 2 respectively 3 of the guiding track 1 there is noted that the upper part of the shank means 2 and 3 of the guiding track 1 forms a support for the reinforcing layer 9 respectively 10 against the transverse forces arising in operation against the guiding surface means 7 and 8 of the shanks 2 and 3 in contrast to the previously known guiding tracks with which the engagement surface extends in a direction of the transverse force whereby the transverse force impinging upon the reinforcing layer is effective completely in the engagement surface and can lead to a separation of the reinforcing layer from the shanks of the guiding track. Since both engagement surfaces 5 and 6 define or encompass the same or equal angle $\alpha$ with the pertaining guiding means 5 and 6 of the shank means 2 and 3 there is noted that both reinforcing layers 9 and 10 can be loaded equally strongly or heavily.

There is naturally possible to embody the engagement surface in a crossection at right angles or vertically with respect to the guiding plane of the guiding track 1, for instance, in a V-saw tooth meandering form and the like. Also in these cases the reinforcing layer 9, 10 becomes supported against transverse forces.

The reinforcing layer 9, 10 can be applied in a known manner subsequent to the hardening, tempering or refinement of the base work material of the guiding track 1. It is essentially more advantageous with respect to the static and dynamic rigidity value when the reinforcing layer 9, 10 becomes applied upon the still untempered base work material of the guiding track 1 respectively of the shanks 2 and 3 and after the application thereof the same becomes tempered together with the work material of the guiding track 1. The entire guiding track thereby receives a high hardness whereby the Stellite alloying shows only a normal suscectability to cracks or faults and makes possible a long durability for utilization thereof.

The present invention concerns a portable motor chain saw with a club-shaped guiding rail which at least at a portion of its circumferential surface on which the saw chain is slidably guided and on the at least approximately semi-circular head of the guiding rail is deviated and carries a reinforcing layer of Stellite applied to the head of the guiding rail by a welding method.

The webs of the guiding rails of motor chain saws are, primarily at their head end which forms the region for the deviation or reversal of the chain, subjected to a considerable wear. In order to reduce this wear to a tolerable extent, the webs located on the circumferential surface of the guiding rail in this zone are protected by highly wear-resistant noniron metal alloys. For this purpose, above all, alloys known under the name Stellite have been employed which, for all practical purposes, are free from iron and consist primarily of chromium, cobalt and tungsten together with certain carbon additions. The application of such non-iron metal alloy upon the base material of the guiding rail may be effected by welding with an acetylene flame or with an electric arc in customary manner.

The base material of the presently produced and marketed guiding rail consists primarily of a high-grade tempered steel which by corresponding heat treatment is tempered so as to have a high strength. With the heretofore known guiding rails, the tempering of the base material is effected prior to the application of the non-iron metal alloy which furnishes the reinforcing layer. However, experience has proved that with such a deposit welding, the zone of the base material which is located directly below the noniron metal alloy, is heated to such high temperatures that as a result thereof the tempered structure is highly annealed and during this deposit welding is converted into an annealed structure which below the reinforced layer forms soft zones. Experience has shown that such structure in view of its low static and dynamic strength is not able to withstand the loads as they occur during the operation of chain saws.

It is, therefore, an object of the present invention with guiding rails of motor chain saws of the above mentioned general type to obtain a considerably higher end strength, above all, relative to the very high wear stresses and bending stresses.

These and other objects and advantages of the present invention will appear more clearly from the following specification in connection with the accompanying drawing.

The portable motor chain saw according to the invention is characterized primarily in that the applied reinforcing layer consists of Stellite and after the application of this layer is tempered or hardened together with the material of which the guiding rail is made. Particularly good results can be obtained when the reinforcing layer consists of approximately 4–9% of tungsten, approximately 25–32% of chromium and at least from 56 to 66% of cobalt.

According to a further development of the invention, it is provided that the reinforcing layer has a hardness of at least 45, preferably of approximately 50 HRc while the hardening range lies between 47 and 55 HRc.

A particularly long life of the guiding rail can be obtained if, in conformity with a further development of the invention, the material for the guiding rail will in that zone thereof which is directly located below the reinforcing zone of Stellite have up to a depth of at least 15 millimeters a hardness of at least 40, preferably of approximately 44 HRc. Preferably, the base material for the guiding rail consists of a tempered steel. Inasmuch as Stellite generally permits or requires a welding or transforming temperature of from 1260° to 1350° C., it is possible within a single tempering operation to temper the base material at 850° C. to such an extent that a fine crystalline tempering structure will be obtained.

Referring now to the drawing of FIG. 1a in detail, the motor chain saw is driven by a high speed one-cylinder gasoline engine which is covered by a sheet metal housing 1' equipped with a longitudinal handle 2' and a transverse handle 3' for guiding the motor chain saw. The motor is adapted by means of a nonillustrated gear connected to the crank-shaft of the motor to drive a chain saw 4' which during its circulation is guided on a club-shaped guiding rail 5'.

Inasmuch as the guiding rail 5', primarily within the region of its semi-circular head end 6' which forms the deviating or reversing zone for the saw chain, is exposed to considerable wear, it is here that the reinforcing layer of Stellite is provided. This reinforcing layer representing, so to speak, an armament, is applied to the circumferential surface of the guiding rail 5' made of high-grade tempered steel, by welding and in a thickness of a few millimeters. After the Stellite has been deposited upon the circumferential surface of the guiding rail 5', the reinforcing layer is, together with the material of which the guiding rail is made, subjected to a temperature treatment and thereby tempered. The reinforcing layer has a Rockwell hardness of from 45 to 55 HRc depending on the grade or type of Stellite, whereas the hardness in the base material of the guiding rail 5' has a hardness of approximately 44 HRc.

Over the heretofore known guiding rails with which the tempering treatment is effected prior to the application or deposit welding and in which below the reinforcing layer there is formed a relatively soft coars crystalline zone in the base material of the guiding rail, with the illustrated guiding rail according to the invention, a considerably increased strength and resistance against bending stresses as well as a greater safety against bending up of the webs on the circumferential surface of the guiding rail is obtained, which webs effect the lateral guiding of the saw chain and are arranged at both sides of the saw chain.

While experience has shown that Stellite is liable to tear, with the embodiment according to the present invention, a Stellite alloy is used for the deposit welding, which alloy contains from 3.9 to approximately 8.9% of tungsten, from 56 to 65% of cobalt and from 24 to 31% of chromium. This alloy has, in spite of great hardness, following the tempering shown only a very low tear liability and assures a long useful life of the guiding rail and motor chain saw.

The literature known in the art has only the welding of Stellite material onto upper surfaces to be protected. The essence of the present invention, however, consists therein that upon the guide rail there is applied a Stellite layer together with the work material-guide rail becoming improved in quality in a tempered hardened coat therewith Canadian Pat. No. 645,422-Carlton issued July 24, 1962 discloses only interchangeable inserts on guide rails for motor chain saws. There cannot be ascertained in the Canadian disclosure any applied layer which becomes tempered together with the work material of the guide rail itself. The present disclosure concens tempering of the Stellite layer together with the work material of the guide rail which must be considered an essential feature of the present invention.

The advantages of the present invention are set forth in detail in the foregoing description or specification. It is correct that at the time the present invention was made, there already existed guide rails which possessed a Stellite-armoring or hard metal armoring at the locations thereof especially subjected or endangered by wear, or being provided with interchangeable insert pieces. However, the present invention is not to be sought in such previously known facts.

The essence of the present invention is the fact that the applied armoring layer (Stellite) after application thereof becomes refined or tempered with the work material of the guide rail. The concern here accordingly is with a heat treatment method through which a better quality of guide rail means can be attained.

As to guide rail production there is known first to temper the guide rail base body and only subsequently thereafter does the Stellite become applied. This method has the disadvantage that during application of the Stellite upon the already treated or tempered guide rail base body there results a soft zone by way of the heat influence between the Stellite and the base body which has a concequence that the applied armoring breaks open, splits open, which means that the same becomes released at the transfer location from the guide rail base body.

By way of the production, in other words by way of the manufacturing method according to the present invention, there becomes attained that no soft zone arises any more between Stellite and the guide rail base body, and accordingly as previously noted there can be avoided the appearances and consequences that have disadvantageous connotations. In view of the foregoing facts, the present invention involves great meaning and importance for motor chains and components thereof.

It is, of course, to be understood that the present invention is, by no means, limited to the specific showing in the drawing but also comprises any modifications within the scope of the appended claims.

What is claimed is:

1. In combination with a guiding track for a portable motor chain saw having chain teeth and a guiding segment for a saw chain that is U-formed in cross section at right angles to the guiding plane and defining shanks between which there is a guiding web engageable by the chain saw members whereby the sides of the shanks directed toward each other form outwardly inclined surfaces forming a groove and are provided at least in a partial range of the guiding track with a highly rigid alloying consisting of a reinforcement layering which is applied upon an outwardly inclined engagement surface upon the particular shank of the guiding track, the improvement thereby which comprises that at least a part of the engagement surface encompasses an angle $\alpha$ of less than 90° with respect to the guiding surface of each shank so that side forces effective upon the chain teeth becomes transformed into a tilt movement which is effective in the groove exclusively in outwardly direction, the entire engagement surface encompassing an angle $\alpha$ of less than 90° with the guiding surface of each shank.

2. A guiding track in combination according to claim 1, wherein both engagement surfaces encompass the same angle $\alpha$ with the pertaining guiding surface of the shank of the guiding track respectively.

3. A guiding track in combination according to claim 1, wherein the reinforcing layer consists of a highly rigid non-ferrous metal alloy.

4. A guiding track in combination according to claim 3, wherein said non-ferrous alloy comprises Stellite with a composition including materials within the range of 4–9% tungsten, approximately 25–32% chromium and at least 56–66% cobalt.

* * * * *